US005299504A

United States Patent [19]

Abele

[11] Patent Number: 5,299,504

[45] Date of Patent: Apr. 5, 1994

[54] SELF-PROPELLED RAIL HEATER CAR WITH MOVABLE INDUCTION HEATING COILS

[75] Inventor: Alan C. Abele, Zelienople, Pa.

[73] Assignee: Technical Rail Products, Incorporated, Cleveland, Ohio

[21] Appl. No.: 906,503

[22] Filed: Jun. 30, 1992

[51] Int. Cl.[5] ..... E01B 29/00

[52] U.S. Cl. ..... 104/2

[58] Field of Search ..... 104/2, 288, 307; 105/12, 35, 50, 451, 463.1

[56] References Cited

U.S. PATENT DOCUMENTS

| | | | |
|---|---|---|---|
| 3,451,470 | 6/1969 | Herrick | 104/2 X |
| 3,521,565 | 7/1970 | Plasser et al. | 104/2 X |
| 3,566,796 | 3/1971 | Herrick | 104/2 |
| 3,896,734 | 7/1975 | Plasser et al. | 104/2 |
| 3,999,276 | 12/1976 | Brown et al. | 104/2 X |
| 5,181,472 | 1/1993 | Scheuchzer | 104/2 |

FOREIGN PATENT DOCUMENTS

| | | | |
|---|---|---|---|
| 933855 | 6/1982 | U.S.S.R. | 104/2 |

*Primary Examiner*—Andres Kashnikow
*Assistant Examiner*—S. Joseph Morano
*Attorney, Agent, or Firm*—Fay, Sharpe, Beall, Fagan, Minnich & McKee

[57] ABSTRACT

A rail heater car for heating rails in a continuous track installation procedure is provided. The rail heater car includes a power generation arrangement for generating the power required for operation of the car. A drive system uses the generated power to propel the car along a set of rails in a transportation mode and a creep mode. An induction heater is connected to and extends from the car for operational engagement with the rails to induce heat in the rails. Data gathering devices are included on the car to input and store data concerning environmental conditions, time, and temperature of the rails for use in adjusting the output of the induction heater and for use in statistical predictive maintenance.

21 Claims, 3 Drawing Sheets

SELF-PROPELLED RAIL HEATER CAR WITH MOVABLE INDUCTION HEATING COILS

BACKGROUND OF THE INVENTION

This invention pertains to the art of heating rails during railroad track installation. The invention is particularly applicable for use in heating continuous rails in conjunction with railroad track installation. However, it will be appreciated that the invention has broader applications and may be advantageously adopted and used in other environments.

Many recent advancements have been made in the laying of railroad track. A popular method in use today employs continuous welded rail. In this operation, individual sections of rail, each being approximately a quarter mile long, are laid on a prepared rail bed by a rail laying device. The rail laying device moves at a constant speed dispensing and initially aligning the quarter mile long rails. At appropriate junctures, i.e. the end of one quarter mile section and the beginning of another quarter mile section, a weld is made to join the two sections. Following the rail laying device at an appropriate distance and pace is an anchoring device for anchoring the rail to the prepared bed at appropriate locations. Generally speaking, this same process applies to replacement of worn rails in existing rail lines.

As a result of investigations of this rail laying technique, it has been found that anchored rails deform, due primarily to climatic changes, causing kinks and pull-aparts in the anchored rail. Pull-aparts cause one end of a rail to pull away from an adjoining end, thus creating a gap between the rails. A kink in one of the rails typically results in a distortion of the rail and non-parallel arrangement of the rails. Kinks and pull-aparts are, of course, a cause for concern as either presents the potential for derailing and/or rough ride of a railcar thereover. Therefore, it is desirable to anchor the rails in such a manner as to preclude the rails from kinking or pulling apart.

It has been determined that it is possible to control elongation of a rail be preheating the rail to a nominal temperature as it is being anchored. By controlling the elongation of the rail during the anchoring procedure and thus laying the rail under controlled, predetermined conditions, it is possible to limit the development of kinks and pull-aparts. Therefore, preheating a rail is deemed desirable for both increasing the durability of the welds between the rail sections and to control the elongation of the rail during the anchoring procedure.

Prior attempts to preheat the rails during installation have been attempted using propane heating systems. Drawbacks in the propane heating system include an inconsistency in the heating of the rail, since some sections of the rail may be heated to a higher temperature than other sections. This inconsistent heating occurs since some burners used in the system produce a higher temperature than other burners.

An additional problem with a propane based heating system is the tendency of the burners to burn and scorch the wooden ties to which the rails are anchored. Ignition of brush located alongside the railroad right-of-way is also a problem associated with the use of propane burners. There is a further concern as to the safety of the operators working with an open flame environment and working in close proximity to large amounts of propane gas.

As installation of rail is an ongoing process, including replacement of worn rails in existing systems and the laying of rails for new rail lines, there is a need to develop a more efficient and controlled manner of heating the rails during installation. It has, therefore, been considered desirable to develop a self-propelled rail heating device. Such a device should be economical to manufacture, have means to accurately and evenly heat the rails in a controlled manner, be of a sturdy, safe, overall construction, and be arranged to perform its operations in concert with the additional devices in a continuous rail laying operation. The subject invention is deemed to meet the foregoing needs and others.

SUMMARY OF THE INVENTION

In accordance with the subject invention, a rail heater car is provided. The heater car includes a generator for producing the power requirements for operation of the rail heater car. A drive arrangement propels the car along a set of rails in a transportation mode that is used when the rail car is not heating the rails. It also provides a creep mode for use when the car is performing heating operations. The drive arrangement obtains its power requirements from the power generator. An induction heater is also provided on the car and extends from the lower portion thereof such that it is in operational engagement with the rail(s) in order to induce heat therein.

In accordance with a more limited aspect of the invention, the car includes data gathering and storing devices to gather and store data concerning environmental conditions, time, location of the car, and temperature of the rails. The gathered data can then be used to determine the energy necessary for providing a desired induced heat in the rails and the stored data used in predictive maintenance of the rails.

In accordance with another aspect of the invention, a vertical and lateral moving device is provided to move the induction heater into and out of operational connection with the rails.

In accordance with still another aspect of the present invention, the induction heater is a channel induction coil which is lowered over a rail such that the rail passes through the electric field of the coil thereby inducing heat in the rail.

In accordance with yet another aspect of the invention, the power generator, drive arrangement, and induction heater are constructed in modular forms whereby the power generator can be quick-disconnected from the remaining structure of the rail car.

A principal advantage of the present invention is the provision of a self-propelled rail heater car which can inductively heat rails in a continuous rail installation operation.

Another advantage of the invention resides in the inclusion of data gathering and storage devices which record and store data used to adjust the generation of inductive heat dependent thereon and for use of the stored data in predictive maintenance studies.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, preferred embodiments of which will be described in detail in this specification and illustrated in the accompanying drawings, which form a part hereof and wherein.

DETAILED DESCRIPTION OF THE PREFERRED EMBODIMENTS

Figure 1:
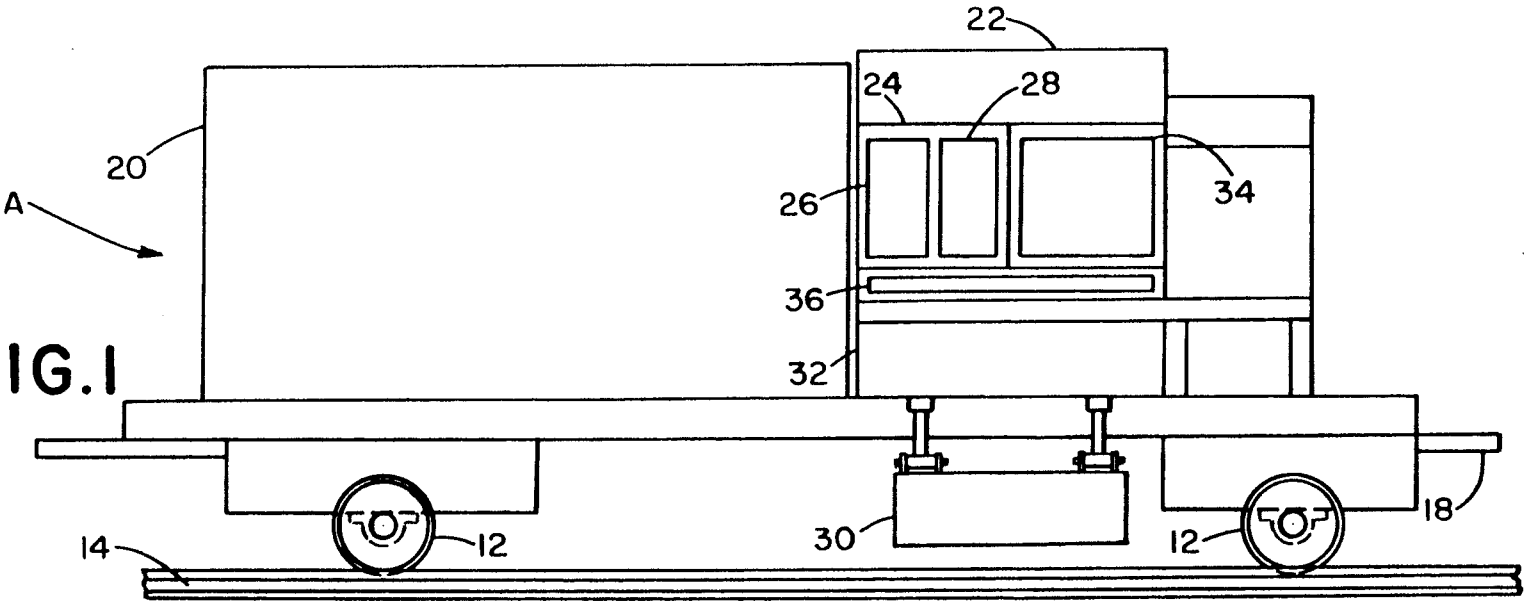
FIG. 1 is an elevational view of the subject invention.

Referring now to the drawings, wherein the showings are for purposes of illustrating the preferred embodiments of the invention only, and not for purposes of limiting same, FIG. 1 shows a self-propelled rail heater car A. Wheels 12 of the rail Car A ride on rails 14 in a commonly known fashion. A frame 16 of car A in the present embodiment has a length of approximately 25 feet and a width of approximately 8 feet, 6 inches. Towing heads 18 are provided on each end of the car for towing the machine when it is not independently driven and operated.

A generator system 20 is included as part of the rail heater car A. The generator system provides the majority of power required for operation of the rail heater car. The present embodiment will incorporate a V-12 Caterpillar ® 500–600 KW single phase 60 cycle 200 V generator set or similar type generating system (Caterpiller is a Registered Trademark of Caterpillar Inc. of Peoria, Illinois). The generator system 20 is integrated into the rail heater car A in a modular construction with quick connect/disconnect fasteners provided by a pin arrangement so that the generator 20 can be lifted from the rail heater car A by removing a series of pins and disconnecting the necessary electrical connections.

All electrical controls of the generator system 20 are housed in a controlled temperature enclosure (not shown) that provides proper cooling and heating for sensitive electrical components, as well as protecting the components from the environment. A control console (not shown) is mounted in a control area 22 enabling an operator to control generator output. In the present embodiment, a control console, such as a Caterpillar ® control panel corresponding to the Caterpillar ® generator system, is used. Of courese it will be understood that similar control systems may be used without departing from the scope and intent of the subject invention.

Due to the significant electrical power requirements for the rail heater car A, the generator system 20 of the present embodiment is approximately 8 feet by 25 feet. The quick connect/disconnect feature along with the modularity allows the generator system 20 to be separately lifted by a crane or the like from the remaining elements of the rail heater car A.

The drive system 24 includes suitable rail wheels 12 and axles. The axle of the drive is supported by pillow block bearings (not shown). The drive is reversible and is capable of producing a speed of approximately 20 miles per hour in both directions, and is capable of starting from a dead stop on a 2% adverse grade. Dynamic braking by way of a hydraulic propulsion system provides a four wheel, fail-safe brake system. Additionally provided are emergency mechanical hand brakes (all not shown).

The drive system 24 operates in a transportation mode which allows the rail heater car A to travel at an approximate maximum speed of 20 miles per hour. The transportation mode operates by a first or transportation transmission drive 26 which controls operation when the rail heater can A is not heating the rails.

When the rails are being heated, the rail heater car operates in a second or creep mode which travels from zero (0) approximately fifty (50) feet per minute or more. The creep mode is operated by a creep transmission drive 28 which may be separate from the transportation transmission drive 26.

An induction heater 30 movably connected to the frame 16 drops over the rail 14 and preheats the rail to a predetermined nominal temperature. In the present embodiment, the nominal temperature is approximately 125° for a low temperature. In the present embodiment, the induction heater 30 takes the form of an electric induction channel coil capable of delivering approximately 500/KW per hour of energy directly to the rail and is capable of full modulation through its power output range so as to accommodate high rates of production and the requirement of continuous uniform heat within the rail.

The standard rail has a weight of approximately 135 lbs/yard. Assuming the rate of movement of the rail heater car A at 44/feet per minute, temperature rise in the rail of approximately 100° F. can be achieved. The use of the electric induction heater provides a consistent controllable heat to the selected rail. The selected characteristics of the 500 KW supply provides approximately 100° Fahrenheit rise at a travelling rate of 44 feet per minute, or a 75° F. rise at a travelling rate of 50 feet per minute, or a 50° F. rise at a travelling rate of 75 feet per minute, or a 25° F. rise at a travelling rate of 150 feet per minute.

Figure 2:
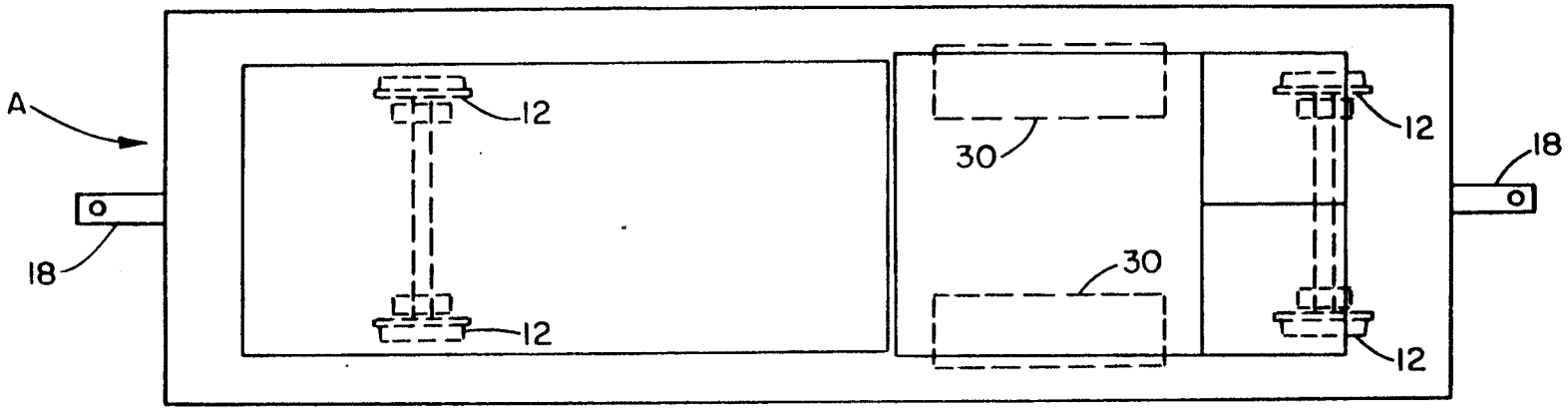
FIG. 2 is a top view of a preferred embodiment of the present invention.

FIG. 1 shows the heater arrangement 30 located in spaced relation from the rail 14. Thus, in FIG. 1, the heater 30 is in a non-operational state. As can be seen in the phantom outlines of heater 30 in FIG. 2, the heater arrangement of the present embodiment can be moved to engage either of the rails on which the rail heater car A is operating. The ability to move the heater in both vertical and lateral directions is provided by the vertical and lateral movement mechanism 32 which will be described in greater detail in connection with FIGS. 3–5.

Also shown in FIG. 1 is a block diagram representing data gathering and storage equipment 34. Included among the equipment 34 are detectors and recorders for gathering and recording data concerning environmental conditions such as ambient temperature, wind velocity and wind direction. Also included among equipment 34 are sensors which detect the time at which the heating occurs, the location of the rail heating car along the rail line, and the temperature of the rails during the heating process.

In the present embodiment, an operator can observe the data being gathered and correspondingly adjust the output of the induction heater 30 to maintain the heat developed in the rail at the desired nominal temperature. In another embodiment of the present invention, the gathered data can be input into a microprocessor or digital signal processor based control system to automatically adjust the energization of the heater 30 according to set parameters corresponding to the gathered data. In addition, the stored data can be used at a later time with statistical predictive maintenance programs. Use of the data in this manner can improve the efficiency of when and where rail track should be replaced.

Battery 36 is provided to operate the vertical and lateral movement mechanism 32. This battery is separate from the generator arrangement 20. Isolation of battery 36 assures that heater 30 can be lifted off the track should a malfunction in the rail heater car A occur. Of course, if desired, the movement mechanism can be powered by the generator with a back-up or safety arrangement provided by the battery.

Figure 4:
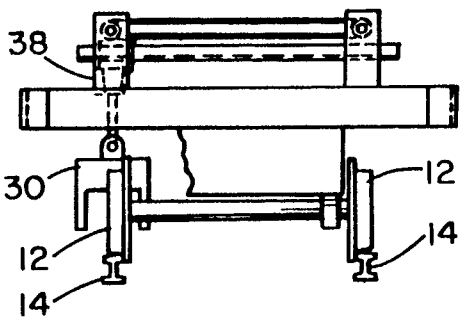
FIG. 4 is an end view taken generally from the right-hand side of FIG. 3.
Figure 3:
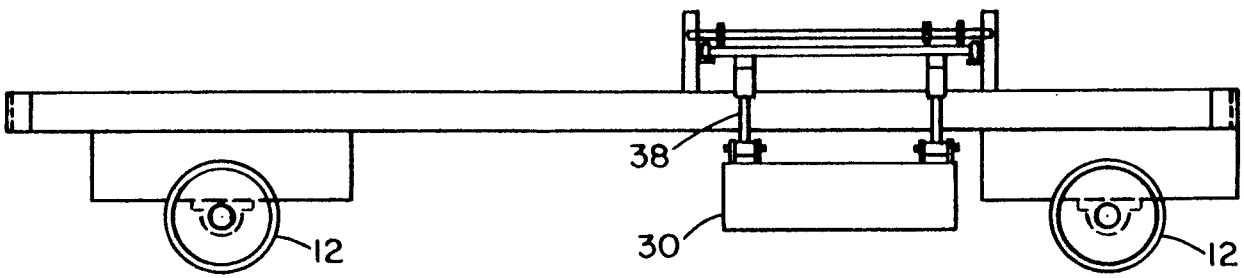
FIG. 3 is an elevational view of a portion of the present invention particualrly detailing the vertical and lateral moving device of the present invention.
Figure 5:
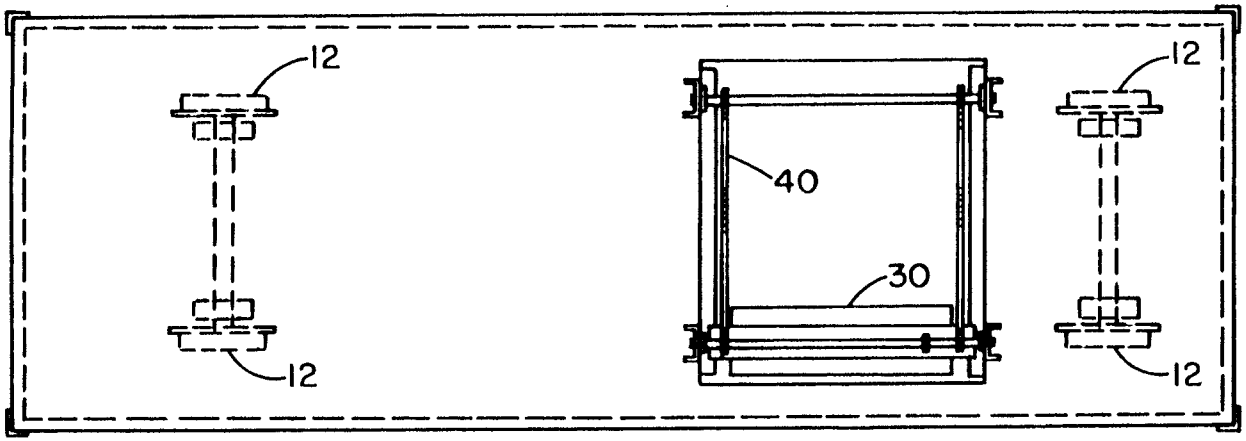
FIG. 5 is a top view of FIG. 3.

Turning attention to FIGS. 3–5, a more detailed description is provided. In the present embodiment, mechanism 32 is contemplated as being an electric screwjack 38 that selectively raises and lowers the heater 30 into operational engagement with the rail 14. When the heater is not in operational engagement, it is sufficiently raised above the rail 14 such that it will avoid debris which may be on the rail bed. FIG. 5 shows a reciprocating means 40 which allows the heater unit 30 to traverse laterally from one side of the rail heater car A to the opposite side thereof, terminating at a position above the rail 14.

FIG. 4 shows an end View of the heater 30. This Figure more clearly discloses that the heater 30 of this embodiment is preferably an induction channel coil. It is to be appreciated that the heater is not limited to use of a channel induction coil and that still other arrangements can be used in accordance with the teachings of the subject invention. In FIG. 4 the heater 30 is not in operational engagement with the rail but is lowered by the vertical and lateral movement mechanism 32 so that the coil of the heater 30 will surround the rail 14. In this manner, the rail is passed through the electrical field produced in the coil. This movement through the induction coil induces heat within the rail 14 in a well known manner. Generating heat by this induction method provides for consistent controllable heat throughout the rail. As can also be seen in FIG. 4, the channel in the rail is of a dimension such that while it can effectively heat the rail, it will pass over ties and anchors holding down the rail 14.

Figure 6:
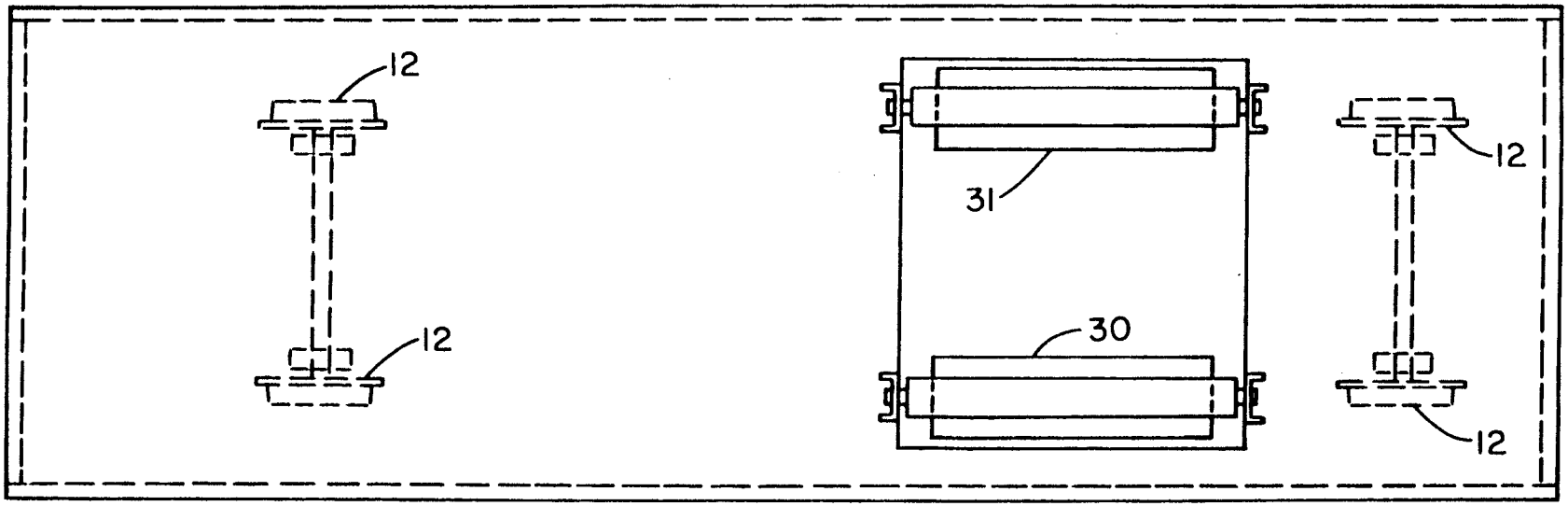
FIG. 6 is an alternative embodiment of the present invention.

FIG. 6 shows a top view of another embodiment of the present invention wherein the lateral reciprocating means 40 is not required. Instead, two induction heaters 30 and 31 are included in the system. By this arrangement, only the vertical raising and lower device 38 is required.

The invention has been described with reference to the preferred embodiments. Obviously, modifications and alterations will occur to others upon reading and understanding the preceding detailed description. It is intended that the invention by construed as including all such modifications and alterations insofar as they come within the scope of the appended claims or the equivalents thereof.

Having thus described the preferred embodiment, the invention is now claimed to be:

1. A rail heater car comprising:

a power generation means for generating power required for operation of the car;

drive means for propelling the car along a set of rails in a transportation mode and a creep mode, the drive means receiving its power requirements from the power generation means;

induction heater means connected to and extending from the car for operational engagement with the set of rails to induce heat into the set of rails, the induction heater means including first and second induction coils located on opposite sides of the car;

vertical moving means for moving the induction coils in a vertical plane for selectively lowering the coils from the car into operational position with the rails and for raising the coils from each of the rails and out of operational engagement with each of the rails; and, a battery means for powering the vertical moving means, the battery means being electrically isolated from the power generation means.

2. The rail heater car according to claim 1, further including data gathering and storing means for gathering and storing data including environmental conditions, time, location of the car and temperature of the rails, when the rails are inductively heated.

3. The rail heater car according to claim 1, wherein the induction heater means includes a single induction coil.

4. The rail heater car according to claim 1, wherein the power generation means, drive means and induction heater means are constructed as modular units.

5. The rail heater car according to claim 4, wherein the modular power generation means is separately detachable from the car.

6. The rail heater car according to claim 1, wherein the induction heater means is a channel induction coil.

7. A self-propelled railroad car for continuously heating a rail, the car comprising:

a power generating system carried on the car for generation of power required for operation;

an induction heater extending from a lower portion of the car for selective operational engagement with the rail to induce heat therein;

a drive system including a creep drive transmission for driving the car in a creep mode during operation of the induction heater and a transportation drive transmission for driving the car in a transportation mode at other times; and, data gathering and storing means for gathering and storing data related to conditions existing at a time the induction heater induces a desired temperature rise in the rail.

8. The railroad car according to claim 7, wherein the gathered and stored data includes environmental conditions, time, location of the car and temperature of the rail being heated.

9. The railroad car according to claim 7, wherein the induction heater is an induction channel coil capable of delivering approximately 500 KW per hour of energy directly to the rail and is capable of full modulation though its power output range so as to accommodate high rates of production and continuous uniform heat within the rail.

10. The railroad car according to claim 9, further including a vertical moving means for providing vertical lift and lowering of the heater thereby lowering the heater into operational engagement with the rail and lifting the heater out of operational engagement.

11. The railroad car according to claim 10, further including a central means for controlling speed of the car, position of the heater, output of the heater and braking of the car.

12. A method for continuously heating a set of rails with a self-propelled railroad car, the method comprising the steps of:

generating power for operation of the car by a generator carried on the car;

driving the car along the rails at a selected speed, through operation of a drive system powered by the generator;

moving an induction heater movably connected to the car into operational engagement with the rails;

determining the amount of power to provide to the induction heater to develop a predetermined temperature rise in the rails while the induction heater is in operational engagement of the rails, based on external environmental conditions and the selected speed of the car; and energizing the induction heater according to the determining step, to heat the rails to the predetermined temperature.

13. The method according to claim 12, wherein the induction heater is energized to develop the desired temperature at approximately 125° F.

14. The method according to claim 12, wherein the driving step further includes the steps of, driving the car in a transportation mode of approximately between 5–20 mph through a transportation transmission drive, when the heater is out of operational engagement of the rails; and driving the car in a creep mode of approximately 0–0.25 mph when the heater is in operational engagement of the rails.

15. The method according to claim 12, wherein the step of moving the heater further includes moving the heater laterally from a position above a first rail on a first side of the car to a position above a second rail on a second side of the car.

16. The method according to claim 12, wherein the rails are heated to a temperature to control elongation of the rails as the rails are being anchored such that development of kinks and pull-aparts of the rails are diminished.

17. A rail heater car comprising:

a power generation means for generating power required for operation of the car;

induction heater means connected to an extending from the car for operational engagement with a set of rails to induce heat into the set of rails; and, drive means for propelling the car along the set of rails, the drive means including a creep drive transmission for driving the car in a creep mode during operation of the induction heater means and a transportation drive transmission for driving the car in a transportation mode at other times, the drive means receiving its power requirements from the power generation means.

18. A rail heater car comprising:

a power generation means for generating power required for operation of the car;

drive means for propelling the car along a set of rails in a transportation mode and a creep mode, the drive means receiving its power requirements from the power generation means;

induction heater means including a single induction coil connected to an extending from the car for operational engagement with the set of rails to induce heat into the set of rails;

vertical and lateral moving means for moving the induction coil in a vertical plane for lowering the coil from the car into operational engagement with one of the rails and raising the coil towards the car out of operational engagement with one of the rails, and for moving the coil laterally to place the coil on an opposite side of the car for accessing the other one of the rails.

19. The rail heater car according to claim 18 further including a battery means for powering the vertical and lateral moving means.

20. The rail heater car according to claim 19 wherein the battery means is electrically isolated from the power generation means.

21. The rail heater car according to claim 18 further including data gathering and storing means for gathering and storing data including environmental conditions, time, location of the car and temperature of the rails, when the rails are inductively heated.

* * * * *